US007014090B1

(12) United States Patent
Chang

(10) Patent No.: US 7,014,090 B1
(45) Date of Patent: Mar. 21, 2006

(54) STAPLING DEVICE

(76) Inventor: Chun Yuan Chang, P.O. Box 63-298, Taichung (TW) 40699

( * ) Notice: Subject to any disclaimer, the term of this patent is extended or adjusted under 35 U.S.C. 154(b) by 0 days.

(21) Appl. No.: 10/971,406

(22) Filed: Oct. 25, 2004

(51) Int. Cl.
*B25C 1/00* (2006.01)
*B25C 5/06* (2006.01)

(52) U.S. Cl. ..... 227/132; 227/120; 227/124; 227/134

(58) Field of Classification Search ..... 227/120, 227/119, 96, 134, 128, 123, 124, 132, 110
See application file for complete search history.

(56) References Cited

U.S. PATENT DOCUMENTS

| | | | | | |
|---|---|---|---|---|---|
| 2,312,142 | A | * | 2/1943 | Berger et al. | 227/134 |
| 2,801,414 | A | * | 8/1957 | Mueller | 227/127 |
| 3,625,408 | A | * | 12/1971 | Amakawa et al. | 227/131 |
| 4,025,031 | A | * | 5/1977 | Chi | 227/132 |
| 4,113,164 | A | * | 9/1978 | Muthenthaller | 227/124 |
| 4,202,480 | A | * | 5/1980 | Annett | 227/8 |
| 4,225,075 | A | * | 9/1980 | Chi | 227/119 |
| 4,496,091 | A | | 1/1985 | Yasuda | 227/123 |
| 4,552,296 | A | * | 11/1985 | Sheng | 227/109 |
| 5,009,356 | A | * | 4/1991 | Chang | 227/120 |
| 5,509,595 | A | | 4/1996 | Ho | 227/119 |
| 5,632,431 | A | * | 5/1997 | Lin | 227/109 |
| 5,639,007 | A | * | 6/1997 | Nakamura | 227/109 |
| 5,899,374 | A | * | 5/1999 | Chen | 227/120 |
| 5,931,365 | A | * | 8/1999 | Huang | 227/109 |
| 6,142,355 | A | * | 11/2000 | Wu | 227/134 |
| 6,367,676 | B1 | * | 4/2002 | Opland et al. | 227/123 |

FOREIGN PATENT DOCUMENTS

GB 2032327 A * 5/1980

* cited by examiner

*Primary Examiner*—Scott A. Smith
*Assistant Examiner*—Brian Nash
(74) *Attorney, Agent, or Firm*—Charles E. Baxley

(57) ABSTRACT

A stapling device includes a housing pivotally attached to a base member and having a channel formed by a partition, a staple drive plate slidably received in the housing, a staple magazine slidably engageable in the channel of the housing and having a front staple drive space. A staple feeder is engaged into the staple magazine and includes a spring-biased pusher for forcing staples forwardly toward the staple drive space of the staple magazine, and for allowing the staples to be driven by the staple drive plate, and an actuating device for actuating the staple drive plate to drive the staples. The staple magazine may be easily disengaged from the housing from a rear inlet of the housing.

9 Claims, 5 Drawing Sheets

STAPLING DEVICE

BACKGROUND OF THE INVENTION

1. Field of the Invention

The present invention relates to a stapling device, and more particularly to a stapling device having a staple magazine openable rearwardly from a stapler housing, to allow staples to be easily and quickly changed with new staples.

2. Description of the Prior Art

Various kinds of typical stapling devices have been developed and comprise a base member having an anvil plate, a staple magazine member and a driving member provided with a staple drive plate. A staple guide member and a staple feeder are coupled to the driving member, to feed the staples toward the driving member, and to allow the staples to be suitably driven or hammered by the driving member.

For example, U.S. Pat. No. 4,496,091 to Yasuda discloses one of the typical stapling devices also comprising a staple guide member and a staple feeder to feed the staples toward a driving member. The driving member should be opened or rotated relative to the staple magazine member, to allow new staples to be engaged or fed into the staple magazine member.

In operation, the users may have to use their one hand to hold the base member, and use the other hand to open or rotate the driving member relative to the staple magazine member, and then to use one of the hands to move the staple guide member and/or the staple feeder, to allow the new staples to be engaged or fed into the staple magazine member. However, it will be difficult for the users to open the driving member, and then to change the staples.

U.S. Pat. No. 5,509,595 to Ho discloses another or similar typical stapling device also comprising a staple guide member and a staple feeder to feed the staples toward a driving member, and a recess portion formed in a guide rail of the staple magazine member, to allow the staples to be depressed downwardly to engage with and to contact with the staple magazine member. However, similarly, it will also be difficult for the users to open the driving member, and then to change the staples.

The present invention has arisen to mitigate and/or obviate the afore-described disadvantages of the conventional stapling devices.

SUMMARY OF THE INVENTION

The primary objective of the present invention is to provide a stapling device including a staple magazine openable rearwardly from a stapler housing, to allow staples to be easily and quickly changed with new staples.

In accordance with one aspect of the invention, there is provided a stapling device comprising a base member, a housing pivotally attached to the base member, and including a channel formed therein and defined by a partition and having a rear inlet provided therein, and including a passage formed in front portion thereof and communicating with the channel thereof, a staple drive plate slidably received in the passage of the housing, and movable into the channel of the housing for staple driving purposes, a staple magazine slidably engageable in the channel of the housing via the rear inlet of the housing for receiving staples therein, and including a staple drive space formed in front portion thereof, for aligning with the passage of the housing and the staple drive plate, and for allowing the staple drive plate to engage into the staple magazine and to drive the staples out of the staple magazine, the staple magazine including a rear port formed and provided therein, a staple feeder engaged into the staple magazine via the rear port of the stable magazine, and including a spring-biased pusher for forcing and feeding the staples forwardly toward the staple drive space of the staple magazine, and for allowing the staples to be driven by the staple drive plate, and an actuating device for actuating the staple drive plate to drive the staples.

The staple feeder includes a block, a rod extended from the block, the pusher is slidably engaged onto the rod, and the staple feeder includes a spring engaged between the block and the pusher to bias the pusher away from the block and to feed the staples forwardly toward the staple drive space of the staple magazine.

The staple magazine includes a longitudinal slot formed therein, the pusher includes a protrusion extended therefrom and slidably received in the longitudinal slot of the staple magazine, to stably guide the pusher to move relative to the staple magazine.

The staple feeder includes a hand grip attached to the block for moving the staple feeder relative to the staple magazine and the housing. The hand grip includes at least one latch extended therefrom, for engaging with the housing, and for detachably securing the staple feeder and the staple magazine to the housing.

The staple drive plate includes a cavity formed therein, the actuating means includes a lever pivotally secured in the housing with a pivot pin, and having a first end engageable into and disengageable from the cavity of the staple drive plate, and having a second end, and a drive member pivotally secured to the housing with a pivot shaft, and engaged with the second end of the lever, to selectively rotate the lever relative to the housing, and to selectively disengaged from the cavity of the staple drive plate when the lever is depressed and actuated by the drive member.

A spring member is engaged with the staple drive plate, to bias and force the staple drive plate to engage into the staple magazine and to drive the staples when the first end of the lever is disengaged from the cavity of the staple drive plate. The lever includes a spring biasing device for biasing the first end of the lever to engage into the cavity of the staple drive plate.

The base member includes an anvil plate disposed thereon and having a spring arm extended upward therefrom, for engaging with the housing, and for biasing the housing away from the base member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
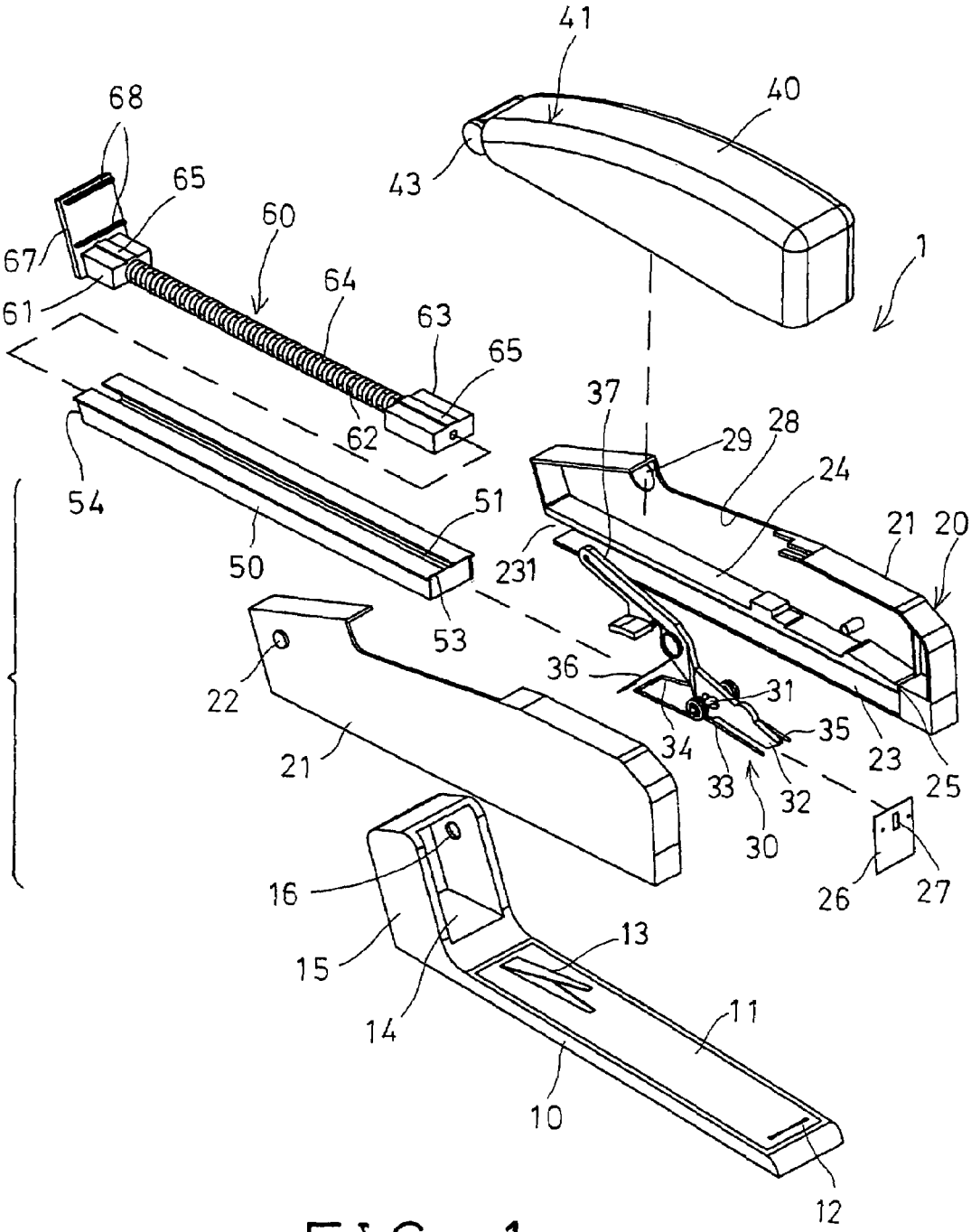
FIG. 1 is an exploded view of a stapling device in accordance with the present invention.
Figure 2:
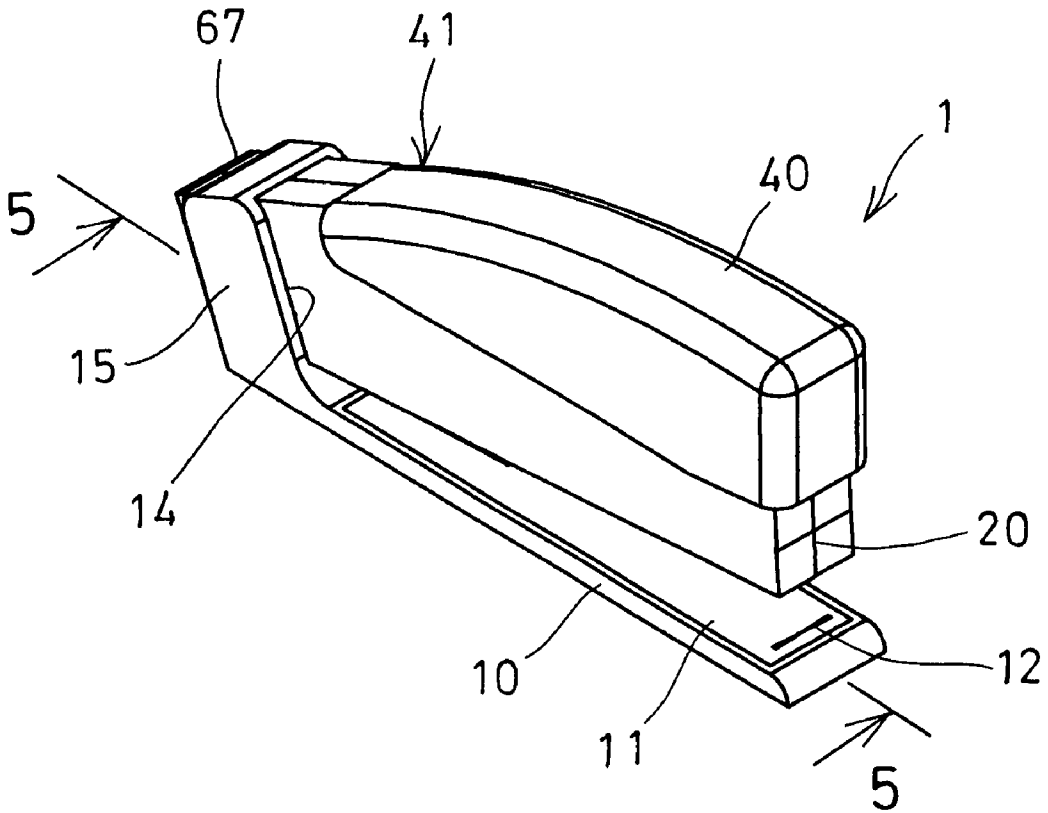
FIG. 2 is a perspective view of the stapling device.
Figure 4:
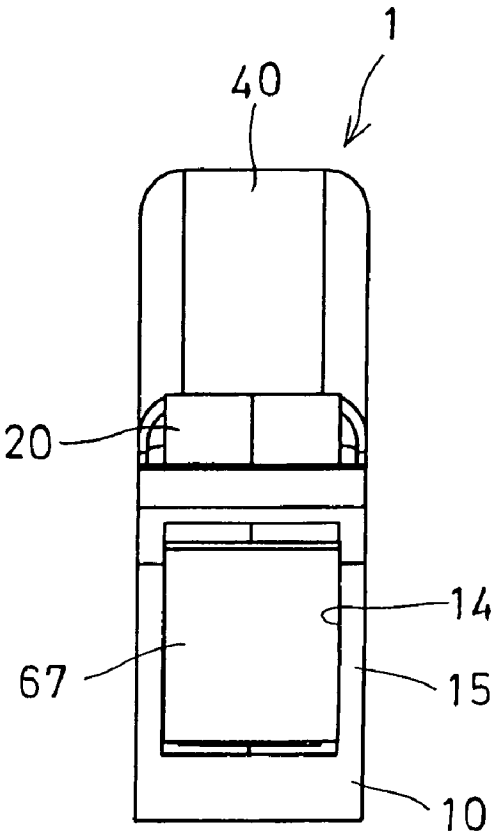
FIG. 4 is a rear plan view of the stapling device.
Figure 3:
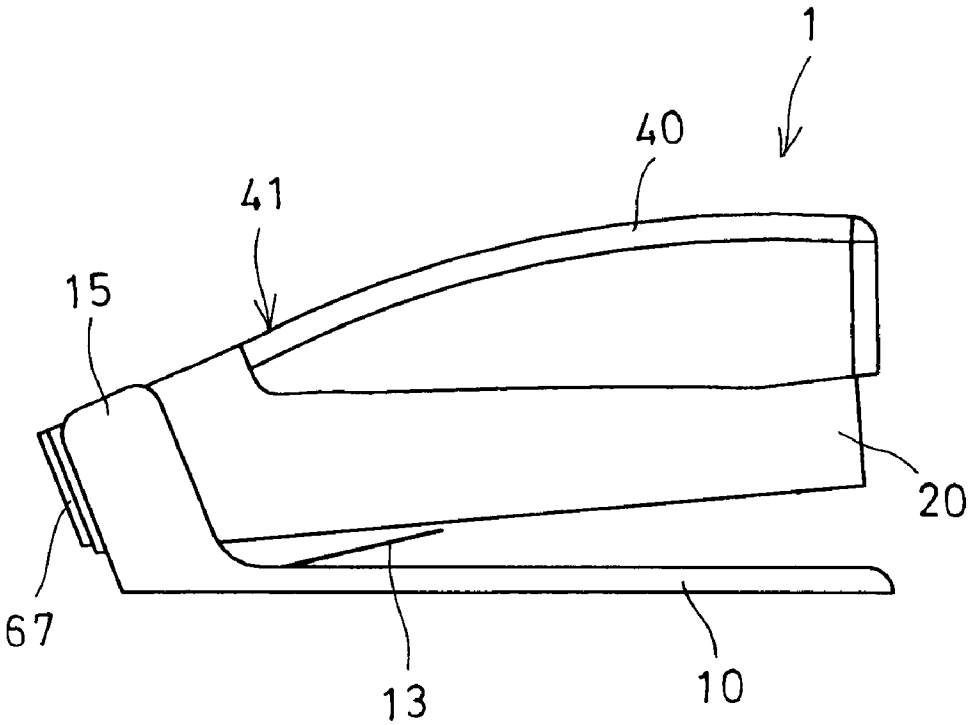
FIG. 3 is a side view of the stapling device.

Referring to the drawings, and initially to FIGS. 1–5, a stapling device 1 in accordance with the present invention comprises a base member 10, an anvil plate 11 disposed in the upper portion of the base member 10 and having one or more inward staple guide depressions 12 formed in such as a front portion thereof, and having a spring arm 13 extended upward from the rear portion thereof. The base member 10 includes a space 14 formed in the rear portion thereof, and defined between two side panels 15 each having a cavity 16 formed therein.

A housing 20 may include such as two housing members 21 secured together by fasteners, latches (not shown), adhesive materials, or by welding processes, or the like, and includes an axle 22 provided on one end thereof for engaging into the cavities 16 of the base member 10, and for rotatably securing the housing 20 to the base member 10, and for allowing the housing 20 to be rotated relative to the base member 10. For example, the axle 22 may be formed by one or more projections 22 extended from the housing 20.

The housing 20 includes a longitudinal channel 23 formed or provided in the lower portion thereof, and defined by a partition 24 and having a rear inlet 231, and includes a passage 25 formed in the front portion thereof, and formed through the partition 24, and communicating with the longitudinal channel 23 of the housing 20, for slidably receiving a staple drive plate 26 therein which is aligned with the depression 12 of the base member 10 and which includes a cavity 27 formed therein.

Figure 5:
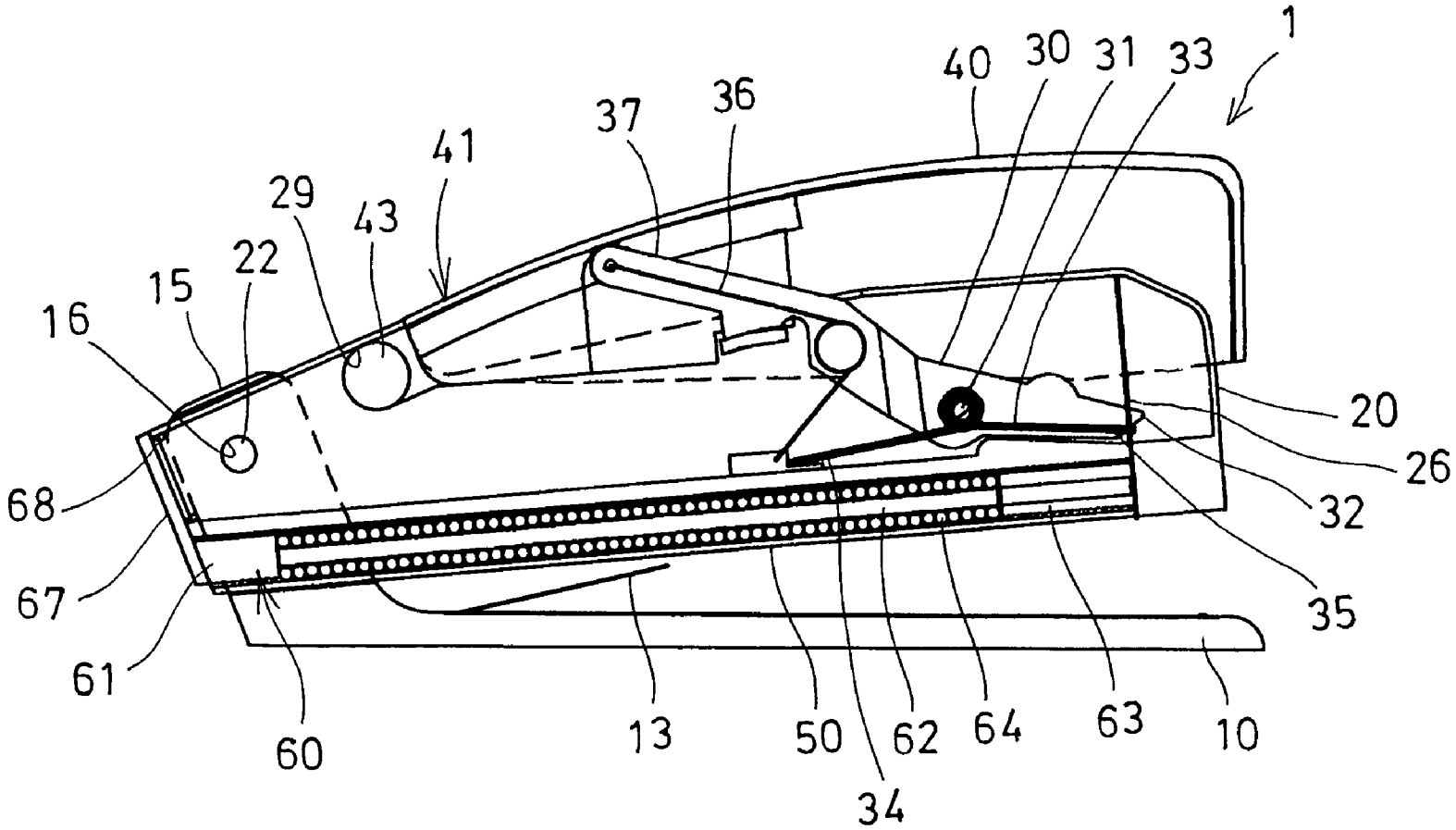
FIG. 5 is a partial cross sectional view taken along lines 5—5 of FIG. 2.
Figure 6:
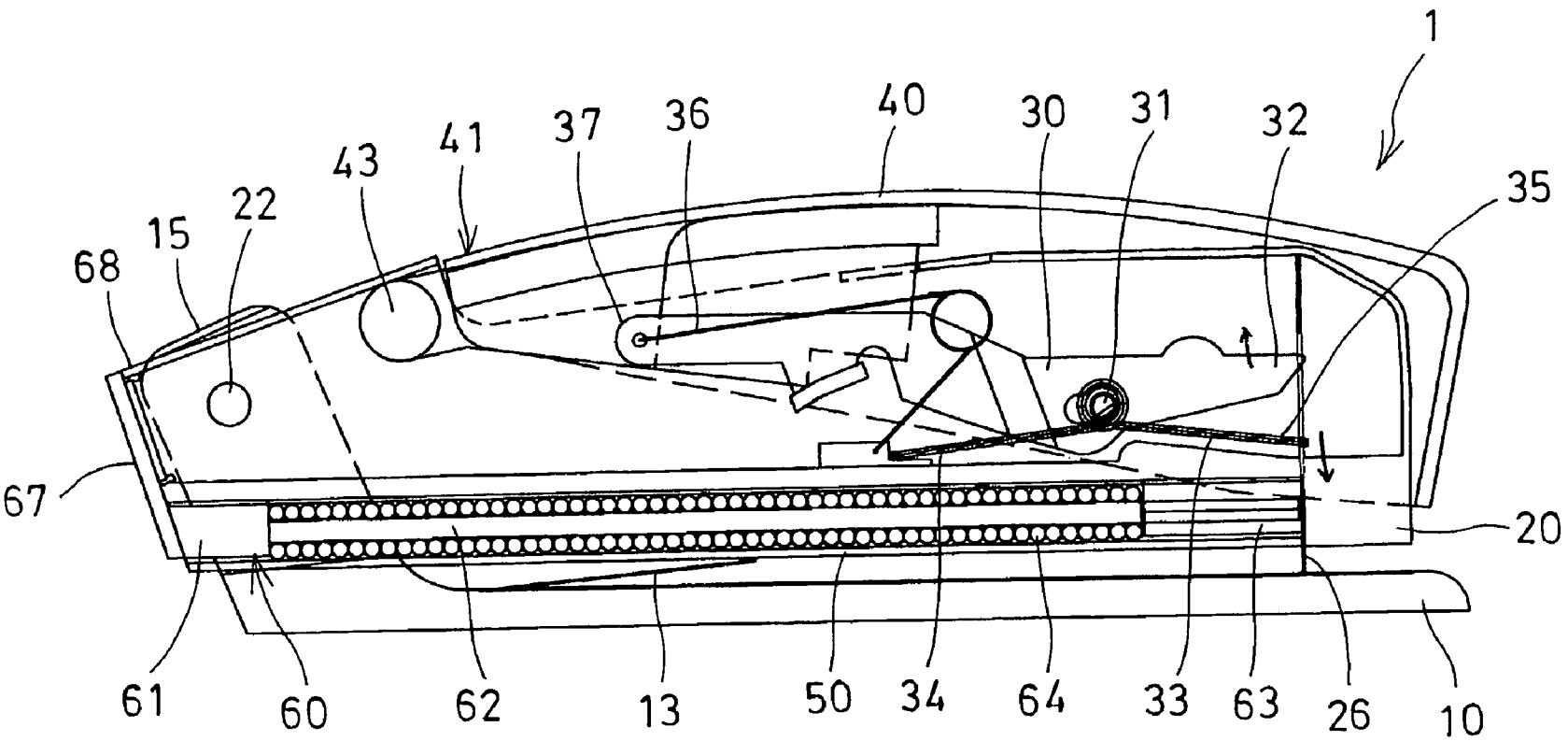
FIG. 6 is a partial cross sectional view similar to FIG. 5, illustrating the operation of the stapling device.

An actuating means or device includes a lever 30 rotatably or pivotally secured in the housing 20 with a pivot pin 31, and having one or front end 32 engageable into and also disengageable from the cavity 27 of the staple drive plate 26. For example, the lever 30 is arranged to allow the front end 32 of the lever 30 to be engaged into the cavity 27 of the staple drive plate 26 when the front end 32 of the lever 30 is moved or rotated downwardly relative to the housing 20 (FIG. 5), and to be disengaged from the cavity 27 of the staple drive plate 26 when the front end 32 of the lever 30 is rotated upwardly relative to the housing 20 (FIG. 6).

A spring member 33 may also be attached or engaged onto the pivot pin 31, and may have one end 34 rested on or secured to the base member 10, and the other end 35 attached or secured to the staple drive plate 26, in order to bias or spring the staple drive plate 26 downwardly and/or outwardly through the passage 25 of the housing 20, for staple driving purposes. Another spring member 36 may further be provided and attached or engaged between the lever 30 and the housing 20, to bias the front end 32 of the lever 30 to engage into the cavity 27 of the staple drive plate 26.

The housing 20 includes an opening 28 and one or more recesses 29 formed in the upper portion thereof. A drive member 40 includes one end 41 engaged into the housing 20 via the opening 28 of the housing 20, and rotatably or pivotally attached or secured to the housing 20 with a pivot shaft 43 which is engaged in the recesses 29 of the housing 20, to allow the drive member 40 to be rotated relative to the housing 20 (FIGS. 5, 6). The other or rear end 37 of the lever 30 is engaged with the drive member 40, to allow the drive member 40 to rotate the lever 30, and to force and to disengage the front end 32 of the lever 30 from the cavity 27 of the staple drive plate 26.

A staple magazine 50 is slidably received or engaged in the longitudinal channel 23 of the housing 20 via the rear inlet 231 of the housing 20, for slidably receiving typical staples therein, and includes a longitudinal slot 51 formed in the upper portion thereof, and includes a staple drive clearance or space 53 formed in the front portion thereof, and aligned with the passage 25 of the housing 20 and the staple drive plate 26, to allow the staple drive plate 26 to be engaged into the staple magazine 50, in order to drive or hammer staples out of the staple magazine 50. The staple magazine 50 includes a rear port 54 formed therein for inserting or feeding staples into the staple magazine 50.

A staple feeder 60 includes a block 61, a rod 62 extended from the block 61 and engageable into the staple magazine 50, a pusher 63 slidably engaged onto the rod 62, and a spring 64 engaged between the block 61 and the pusher 63 for biasing the pusher 63 away from the block 61, and for allowing the pusher 63 to force and to feed the staples forwardly toward the staple drive space 53 of the staple magazine 50, and thus for allowing the staples to be driven or hammered by the staple drive plate 26.

It is preferable that the block 61 and the pusher 63 each includes a protrusion 65 extended upwardly therefrom and slidably received in the longitudinal slot 51 of the staple magazine 50, to stably guide the block 61 and the pusher 63 to move relative to the staple magazine 50. It is also preferable that the staple feeder 60 includes a hand grip 67 formed or attached to the block 61, for allowing the block 61 and the pusher 63 to be engaged into or disengaged from the staple magazine 50 with the hand grip 67. The hand grip 67 includes one or more latches 68 extended therefrom, for engaging with the housing 20, and for detachably or openably securing or anchoring the staple feeder 60 and thus the staple magazine 50 to the housing 20.

In operation, as shown in FIGS. 5, 6, when the drive member 40 is depressed or rotated downwardly relative to the housing 20 from the position as shown in FIG. 5 to that shown in FIG. 6, the other or rear end 37 of the lever 30 may be actuated or depressed by the drive member 40, to force and to disengage the front end 32 of the lever 30 from the cavity 27 of the staple drive plate 26, and thus to allow the staple drive plate 26 to be biased or forced downwardly and/or outwardly through the passage 25 of the housing 20 to drive or hammer the staples by the spring member 33.

When the drive member 40 is released, the other spring member 36 may bias and rotate the lever 30 relative to the housing 20, to bias the front end 32 of the lever 30 to engage into the cavity 27 of the staple drive plate 26 again, and to the original or normal position ready for further staple driving operation. The spring arm 13 of the base member 10 may be used to bias the housing 20 upwardly away from the base member 10 to the original or normal position.

The staple feeder 60 and the staple magazine 50 may be easily and quickly removed or disengaged from the housing 20 with the hand grip 67 of the staple feeder 60, for allowing staples to be easily engaged into or disengaged from the staple magazine 50.

Accordingly, the stapling device in accordance with the present invention includes a staple magazine openable rearwardly from a stapler housing, to allow staples to be easily and quickly changed with new staples.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapling device comprising:

a base member, a housing pivotally attached to said base member, and including a channel formed therein and defined by a partition and having a rear inlet provided therein, and including a passage formed in front portion thereof and communicating with said channel thereof, a staple drive plate slidably received in said passage of said housing, and movable into said channel of said housing for staple driving purposes, a staple magazine slidably engageable in said channel of said housing via said rear inlet of said housing for receiving staples therein, and including a staple drive space formed in front portion thereof, for aligning with said passage of said housing and said staple drive plate, and for allowing said staple drive plate to engage into said staple magazine and to drive the staples out of said staple magazine, said staple magazine including a rear port formed and provided therein, a staple feeder engaged into said staple magazine via said rear port of said staple magazine, and including a spring-biased pusher for forcing and feeding the staples forwardly toward said staple drive space of said staple magazine, and for allowing the staples to be driven by said staple drive plate, and means for actuating said staple drive plate to drive the staples.

2. The stapling device as claimed in claim 1, wherein said staple feeder includes a block, a rod extended from said block, said pusher is slidably engaged onto said rod, and said staple feeder includes a spring engaged between said block and said pusher to bias said pusher away from said block and to feed the staples forwardly toward said staple drive space of said staple magazine.

3. The stapling device as claimed in claim 2, wherein said staple magazine includes a longitudinal slot formed therein, said pusher includes a protrusion extended therefrom and slidably received in said longitudinal slot of said staple magazine, to stably guide said pusher to move relative to said staple magazine.

4. The stapling device as claimed in claim 2, wherein said staple feeder includes a hand grip attached to said block for moving said staple feeder relative to said staple magazine and said housing.

5. The stapling device as claimed in claim 4, wherein said hand grip includes at least one latch extended therefrom, for engaging with said housing, and for detachably securing said staple feeder and said staple magazine to said housing.

6. The stapling device as claimed in claim 1, wherein said staple drive plate includes a cavity formed therein, said actuating means includes a lever pivotally secured in said housing with a pivot pin, and having a first end engageable into and disengageable from said cavity of said staple drive plate, and having a second end, and a drive member pivotally secured to said housing with a pivot shaft, and engaged with said second end of said lever, to selectively rotate said lever relative to said housing, and to selectively disengage from said cavity of said staple drive plate when said lever is depressed and actuated by said drive member.

7. The stapling device as claimed in claim 6, wherein a spring member is engaged with said staple drive plate, to bias and force said staple drive plate to engage into said staple magazine and to drive the staples when said first end of said lever is disengaged from said cavity of said staple drive plate.

8. The stapling device as claimed in claim 6, wherein said lever includes means for biasing said first end of said lever to engage into said cavity of said staple drive plate.

9. The stapling device as claimed in claim 1, wherein said base member includes an anvil plate disposed thereon and having a spring arm extended upward therefrom, for engaging with said housing, and for biasing said housing away from said base member.

* * * * *